US007051895B2

(12) United States Patent
Toussant et al.

(10) Patent No.: US 7,051,895 B2
(45) Date of Patent: May 30, 2006

(54) CONTAINER COVERING SYSTEM

(75) Inventors: John William Toussant, West Chester, OH (US); Elizabeth White Toussant, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/280,327

(22) Filed: Oct. 25, 2002

(65) Prior Publication Data

US 2003/0082320 A1 May 1, 2003

Related U.S. Application Data

(60) Provisional application No. 60/345,987, filed on Oct. 26, 2001.

(51) Int. Cl.
*B65D 51/12* (2006.01)

(52) U.S. Cl. ..... 220/287; 220/213; 220/377; 220/320; 150/154

(58) Field of Classification Search ..... 220/213, 220/287, 305, 319, 320, 359.1, 377; D2/867; 2/195.3, 174; 4/415; 428/35.2, 40.1, 194; 24/300; 292/DIG. 11; 150/154
See application file for complete search history.

(56) References Cited

U.S. PATENT DOCUMENTS

| | | | | |
|---|---|---|---|---|
| 2,064,411 | A * | 12/1936 | Brandstein | 215/321 |
| 2,080,108 | A * | 5/1937 | Brandstein | 215/321 |
| 2,821,230 | A * | 1/1958 | May | 150/154 |
| 3,793,110 | A * | 2/1974 | Saunders | 156/247 |
| 3,862,614 | A * | 1/1975 | Kovac | 215/317 |
| 4,698,242 | A * | 10/1987 | Salerno | 427/208.2 |
| 4,906,108 | A * | 3/1990 | Herrington et al. | 383/71 |
| 5,553,733 | A * | 9/1996 | Rosenthal | 428/35.2 |
| 5,709,312 | A * | 1/1998 | Lake | 220/287 |
| 6,052,825 | A * | 4/2000 | Dodd | 2/68 |
| 6,276,551 | B1 * | 8/2001 | Miller, II | 220/287 |
| 6,351,852 | B1 * | 3/2002 | Propp | 2/174 |
| 2003/0199841 | A1 * | 10/2003 | Ashton et al. | 604/385.01 |

FOREIGN PATENT DOCUMENTS

| | | |
|---|---|---|
| BE | 570960 | 9/1958 |
| DE | 199 55 110 A1 | 5/2001 |
| EP | 0 621 082 A1 | 10/1994 |
| FR | 1315903 | 12/1962 |
| FR | 1429312 | 1/1966 |
| GB | 975783 | 11/1964 |
| JP | 61-115981 | 6/1986 |
| JP | 03-002292 | 1/1991 |
| JP | 07-246216 | 9/1995 |
| WO | WO 96/41604 | 12/1996 |
| WO | WO 02/08067 A2 | 1/2002 |

* cited by examiner

*Primary Examiner*—Nathan J. Newhouse
*Assistant Examiner*—James Smalley
(74) *Attorney, Agent, or Firm*—David K. Mattheis; Leonard W. Lewis; Steven W. Miller

(57) ABSTRACT

A container covering system comprises a flexible film cover including an elastic peripheral portion. The film cover forms a seal around a container on which the covering system is placed.

12 Claims, 5 Drawing Sheets

CONTAINER COVERING SYSTEM

CROSS REFERENCE TO RELATED APPLICATIONS

This application claims the benefit of U.S. Provisional Application No. 60/345,987, filed Oct. 26, 2001

FIELD OF THE INVENTION

The present invention relates to a container covering system, and more particularly, to a container covering system that quickly and easily covers a variety of different sized containers, provides a seal between a cover and a container and seals to nearly any type of material from which a container could be constructed.

BACKGROUND OF THE INVENTION

Container covering systems, such as flexible film covers, have long been used to protect perishable goods such as food while the goods are being stored. The primary purpose of a container covering system is to lock out contaminants, maintain moisture and preserve the goods. Container covering systems of a variety of shapes, sizes and designs have been created to achieve this purpose, but flexible film covers that allow placement around openings of a variety of storage containers have been some of the most successful.

Still, however, there are a number of problems associated with traditional flexible film covering systems. For example, the material used to construct a flexible film covering system, such as a thin-film plastic, a wax coated paper, or an aluminum foil are each limited to covering a certain type of container and typically, wax coated papers and aluminum foils are generally not sealable. Additionally, thin-film plastic materials, such as Handi-Wrap® or Saran™, typically do not adhere to Styrofoam or some other types of containers. More recently, flexible films having a gathered elastic edge have become popular for covering food containers for temporary storage. While these covers are convenient to use and accommodate a variety of different sized containers, they do not sufficiently seal the container as desired for some foods or other perishable goods.

In view of these limitations, it would be advantageous to provide a flexible film covering system that could quickly and easily cover a variety of different sized containers, provide an improved seal between a cover and a container and seal to nearly any type of material including those coated with non stick surfaces.

SUMMARY OF THE INVENTION

The present invention is directed to container covering systems. In one embodiment of the invention, a container covering system comprises a flexible film cover including an elastic peripheral portion. The film cover is configured to form a seal around a container on which the covering system is placed.

In another embodiment of the invention, a container covering system comprises a container body and a flexible film cover. The flexible film cover has an elastic peripheral portion and the film cover is configured to seal the cover to the container body when the cover is placed on the container body.

Yet another embodiment of the invention is directed to a method for sealing a container opening. The method comprises the steps of arranging a flexible film cover having an elastic peripheral portion to cover the container opening, and sealing a portion of the film cover to a portion of the container.

The container covering systems and methods of the present invention are advantageous in that they may be used with a variety of different sized containers to provide an improved seal therewith.

Still other objects, advantages and novel features of the present invention will become apparent to those skilled in the art from the following detailed description, which is simply, by way of illustration, various modes contemplated for carrying out the invention. As will be realized, the invention is capable of other different obvious aspects all without departing from the invention. Accordingly, the drawings and descriptions are illustrative in nature and not restrictive.

BRIEF DESCRIPTION OF THE DRAWINGS

While the specification concludes with claims particularly pointing out and distinctly claiming the present invention, it is believed that the same will be better understood from the following description, taken in conjunction with the accompanying drawings, in which:

DETAILED DESCRIPTION

Reference will now be made in detail to various embodiments of the invention, various examples of which are illustrated in the accompanying drawings, wherein like numerals indicate corresponding elements throughout the views.

Figure 1A:
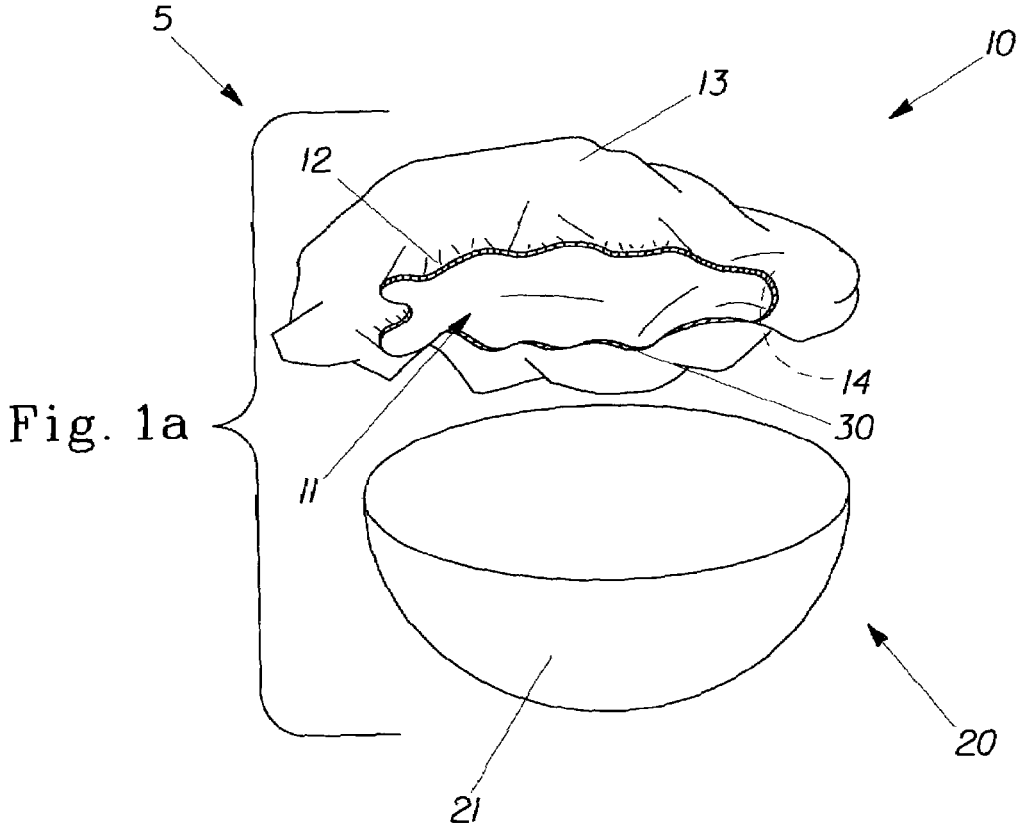
FIGS. 1*a* and 1*b* depict an exemplary embodiment of a container covering system in accordance with the present invention.

FIG. 1*a* depicts an exemplary embodiment of a container covering system 5 comprising a cover 10. Although it should be recognized that a cover 10 might be configured in a variety of different shapes and sizes, in the exemplary embodiment of the invention in FIG. 1*a,* the cover 10 has a substantially circular shape. Specifically, the cover 10 has a generally convex outer surface 13 and a corresponding generally concave inner surface 14 that defines a cavity for receiving a portion of a container 20.

The cover can be constructed from a variety of materials such as any flexible plastic, cloth, rubber, paper, foil or the like. In an exemplary embodiment of the invention, the cover is constructed from a single piece of translucent or preferably transparent thin-film material such as, but not limited to, a polymer selected from the group consisting of polyethylenes (PE), polypropylenes (PP), polystyrenes (PS), polyvinyl chlorides (PVC), polyvinylidene chlorides (PVDC), polyvinyl acetates (PVAC), polyamides, including nylons, polyesters and mixtures thereof. Such a material provides a cover with the flexibility and strength to cover and contain a variety of different sized containers. The translucent or transparent nature of the cover is advantageous to allow the contents of the container to be visible without opening the covering system, but is not required.

The cover comprises an elastic peripheral portion 12 and in one embodiment of the invention, a portion of the cover is configured to contact and provide a "seal" around a container 20 when the cover is placed on the container to cover the container opening. As used herein, the term "seal" or "sealing" means that the contact provided between a cover 10 and a container 20 is substantially air and/or liquid impervious. For example, the contact provided between a cover 10 and a container 20 should be sufficient to prevent significant liquid content leakage upon a tip-over of the container sealed with a cover 10.

In another embodiment of the invention, the elastic peripheral portion 12 of the cover 10 is configured to contact and provide a seal around a container 20 when the cover is placed on the container to cover the container opening. While in both embodiments it is desirable for the seal to form immediately, in some cases it may be acceptable for the seal to form over time such as a seal that results from a gradual flow of sealing or gasketing material. Such a seal can be formed by any variety of "adhesive elements" 30. As used herein, the term "adhesive element(s)" means any composition, coating, material or the like capable of providing a seal such as, but not limited to glue, glue "bubbles", tape, double sided tape or gasketing material such as a conformable and/or compressible gasketing material.

Figure 1B:
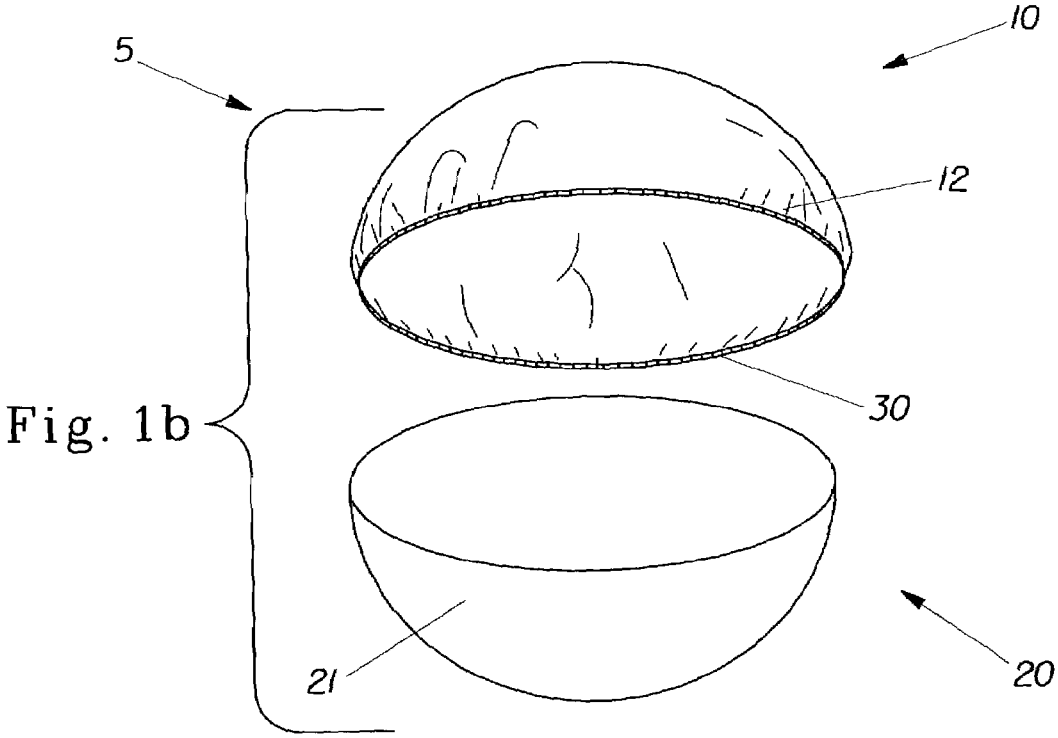

In an exemplary embodiment of the invention, the elastic peripheral portion comprises an elastic edge such as an elastic band, which has elastic properties including the ability to stretch and relax. FIG. 1 a depicts the cover 10 in a relaxed state wherein the elastic peripheral portion 12 is unstretched. In contrast, FIG. 1*b* depicts the cover 10 in an unrelaxed state wherein the elastic peripheral portion 12 is stretched so that the cover 10 will fit over the openings of a variety of different sized containers and wherein the elastic peripheral portion 12 will provide contact and preferably seal around substantially an entire outer surface 21 of container 20. While an air and/or liquid tight seal is preferred, there may be occasions when a user desires the enclosed container to be ventilated. This may be accomplished in any number of ways including puncturing the film and/or interrupting the seal formed between the cover 10 and the container 21.

In a non-limiting embodiment of the invention, the cover 10, or a portion of the cover, is configured to provide a seal around a container on which the covering system is placed. In this embodiment, the cover may comprise an adhesive element 30, such as an adhesive glue coating that allows a portion of the cover to seal the container. Nonetheless, in an exemplary embodiment of the invention, it is the elastic peripheral portion 12 of the cover 10 that comprises the adhesive element 30 for providing the seal around the container on which the covering system is placed. In other words, the elastic peripheral portion of a cover is configured to form a seal around a container 20 to prevent air and/or liquid from penetrating the container. For example, it is contemplated an adhesive element 30 of an elastic peripheral portion 12 may comprise an adhesive coating, or some other application or attachment of an adhesive to the elastic peripheral portion 12. In this embodiment, the adhesive element 30 of the elastic peripheral portion 12 may comprise a coating of glue, glue "bubbles", or double sided tape positioned around the elastic peripheral portion 12.

The cover 10 or the elastic peripheral portion 12 of the cover having an adhesive element 30, may be formulated to be releaseably resealable to any variety of different food containers such as a container 20 constructed from wood, glass, plastic, metal, ceramic, paper or any other common household material. The term "releasably resealable" includes the meaning that a cover 10 might be capable of a plurality of uses on the same container or on a different container having a different shape and/or different material characteristics.

Figure 2:
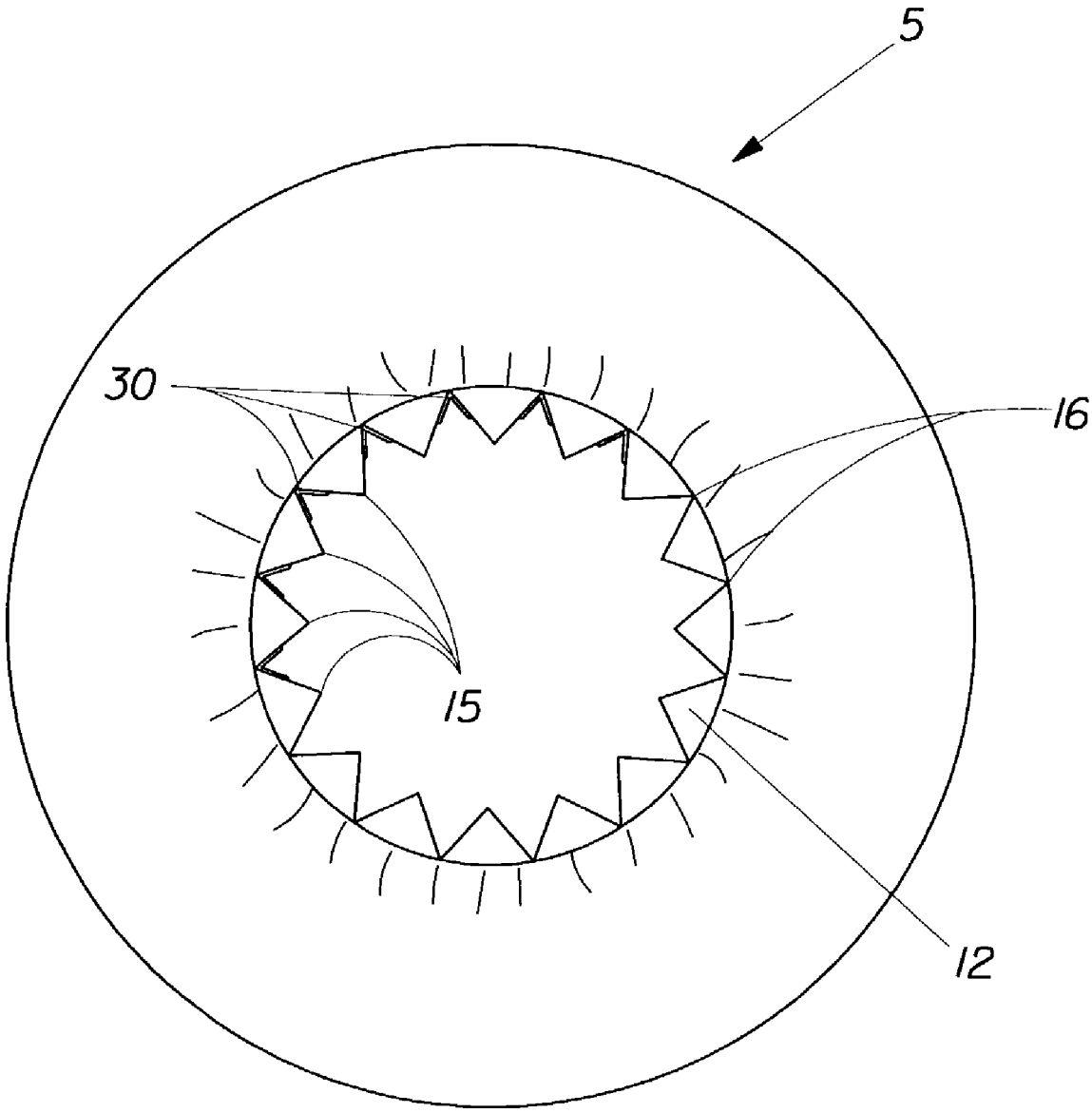
FIG. 2 depicts an exemplary plan-view of a second embodiment of a covering system in accordance with the present invention.

FIG. 2 depicts a second embodiment of a container covering system 5 in a relaxed state in accordance with the present invention. In this embodiment, the elastic peripheral portion 12 comprises a contoured elastic band having areas which are not surface exposed in the relaxed state of the band, but which, upon stretching of the band, are exposed to adhere the elastic band to a desired surface. Thus, stretching the elastic exposes the adhesive element of the elastic. For example, in an unstretched or relaxed state, the elastic peripheral portion 12 may comprise a substantially "zig-zag" or accordion-like shape, wherein the elastic peripheral portion 12 has a plurality peaks 15 and valleys 16. Valleys 16 and portions of the elastic extending toward the peaks comprise an adhesive element 30 configured to adhere, conform, or stick to a variety of surfaces. In the relaxed or unstretched state, the surface that contacts elastic peripheral portion 12 will contact the peaks 15, rather that the adhesive valleys 16, and thus not adhere to the covering system or other unintended surfaces. In other words, the adhesive element of the elastic peripheral portion 12 is inactive when the elastic peripheral portion 12 is in a relaxed state. In contrast, in a stretched state, the valleys 16, including portions of the elastic extending toward the peaks, are exposed due to the stretching of the elastic such that a surface contacting the stretched elastic peripheral portion 12 will contact portions of adhesive element 30. As such, the cover 10 seals an outer surface 21 of a container 20 due to the adhesive element the elastic peripheral portion 12. As will be apparent, the length and the elasticity of the elastic peripheral portion 12 will be configured such that placement of the covering system on a container will allow exposure of at least a portion of the adhesive element 30.

In more detail, it should be recognized that the elastic peripheral portion 12 of the present invention, could be contoured in two dimensions or three dimensions and that various cross-sectional shapes of the contoured elastic could be configured such that the contoured elastic has surfaces that are exposed when the elastic is in a relaxed state and additional surfaces that become exposed when the elastic is in a stretched state. It should be understood that the initial exposed surfaces do not have an adhesive element, whereas the surfaces that become exposed when the elastic peripheral portion 12 is in a stretched state exhibit an adhesive element 30. One of ordinary skill in the art should understand that the adhesive element 30 applied to the contoured elastic might also have elastic properties such that the adhesive does not prevent the elastic peripheral portion 12 from stretching or contracting to seal to a container as needed.

Figure 3:
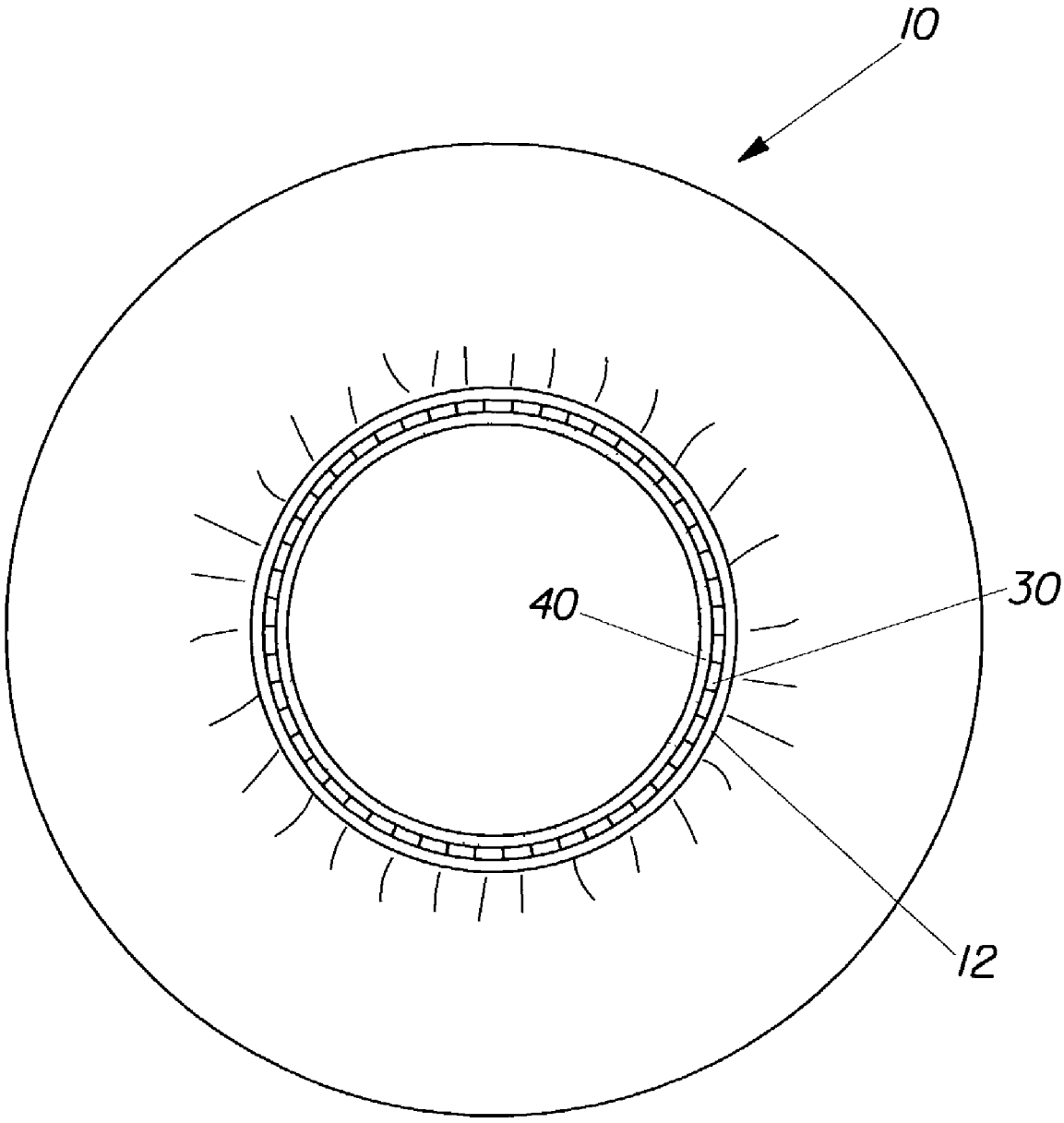
FIG. 3 depicts a plan-view of a third exemplary embodiment of a covering system in accordance with the present invention.

FIG. 3 depicts a third embodiment of the present invention, wherein the adhesive element 30 of the elastic peripheral portion 12 is located around an inner surface 31 of the elastic peripheral portion 12. In this embodiment, the elastic peripheral portion 12 comprises an adhesive element 30 and a protective coating 40 configured to prevent the adhesive element 30 from sticking to any unintended surface when the elastic peripheral portion is in a relaxed state. In an exemplary embodiment, a protective coating 40 is applied to the adhesive element 30 to prevent the adhesive from adhering to an unintended surface. Such a protective coating 40 may comprise a low cost powder such as talc, calcium carbonate, starch particles, silicon dioxide, or the like. Although the protective coating 40 is represented as a "thickness" in FIG. 3, it should be recognized that the protective coating merely has to cover the adhesive element 30 to prevent the adhesive from sticking to an unintended surface.

In one embodiment of the invention, stretching the elastic peripheral portion 12 will break or separate the protective coating 40, thereby exposing fresh adhesive capable of sealing a cover 10 to a portion of a container 20. In another embodiment, the adhesive element 30 on the elastic peripheral portion 12 is a pressure sensitive adhesive such that "pressuring" the elastic peripheral portion 12 causes fresh adhesive to break through the protective coating 40, thereby allowing the cover 10 to adhere to and seal the container 20. For example, in this embodiment, a user of the container covering system 5 might stretch the cover 10 to fit on a container 20 and proceed to "rub" a thumb or finger over an elastic peripheral portion 12 thereby causing fresh adhesive to be exposed, thereby sealing the cover 10 to a portion of the container 20. In yet another embodiment, while not wishing to be bound by theory, it is contemplated that where a powder coating is used to protect the relaxed elastic peripheral portion 12 from unintentional sticking of the adhesive element 30, the powder might upon stretching and pressing to a desired surface, become submersed in the adhesive thereby allowing more adhesive to be exposed.

Figure 4:
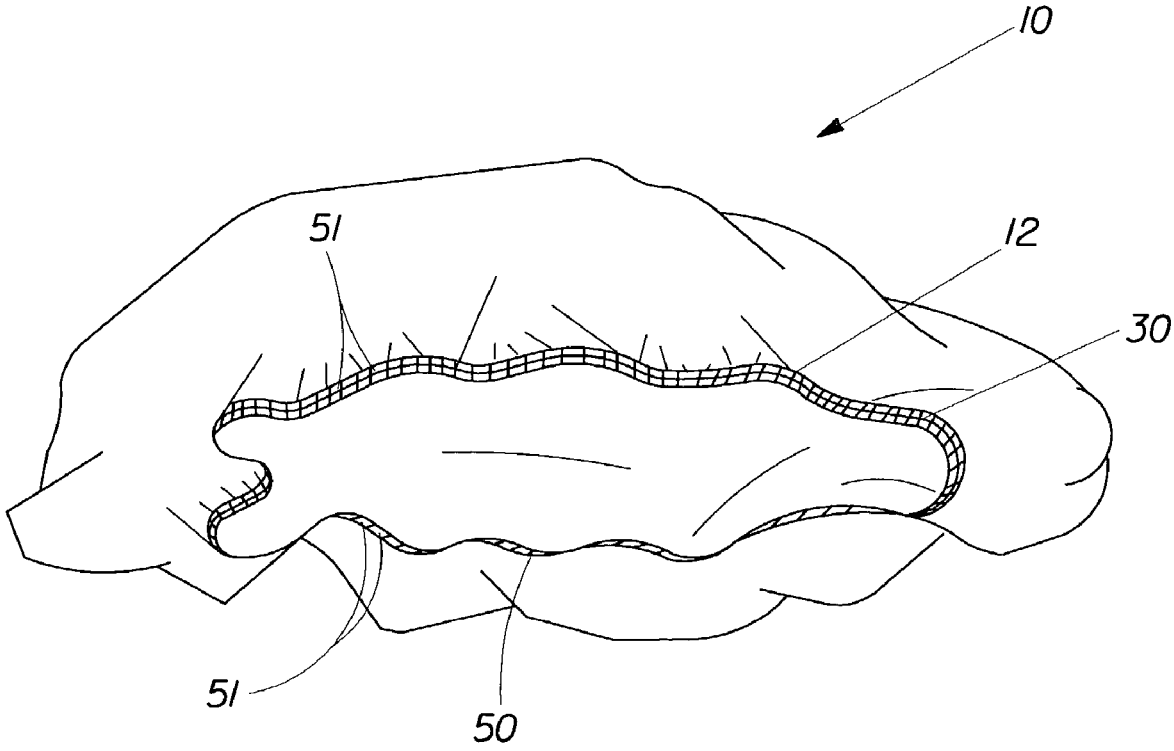
FIG. 4 depicts a fourth embodiment of a container covering system in accordance with the present invention.

FIG. 4 depicts a fourth embodiment of a container covering system 5 in accordance with the present invention. In this embodiment, the food covering system 5 comprises the cover 10 having the elastic peripheral portion 12 and the adhesive element 30 for sealing the cover 10 to an outer surface 21 of a container 20. In this embodiment, however, the cover 10 further includes a protective cover 50 configured to cover the exposed adhesive element 30. In more detail, the protective cover 50 protects the adhesive element 30 from sticking to an unintended surface. In this embodiment, the protective cover 50 is stitching 51 formed by sewing a looping overlock stitch on the elastic peripheral portion 12. Stitching 51 may include a low or no stick substance such as wax, fluorocarbon, silicone, or other material. The elastic peripheral portion 12 having the adhesive element 30 is preferably positioned or covered within the sewn protective cover 50 and configured to "float" or slide within the protective cover 50 due to the non-stick nature of the stitching 51. In an exemplary embodiment, the looping stitch coverage might range from completely covering the elastic peripheral portion 12 to spacing the stitches to result in about 50% coverage. In other words, a protective cover 50 might cover at least 50% of the adhesive element 30. A commercially available thread treatment for use in this embodiment comprises Sewers Aid, available from Collins, Inc., Whippany, N.J.

Figure 5:
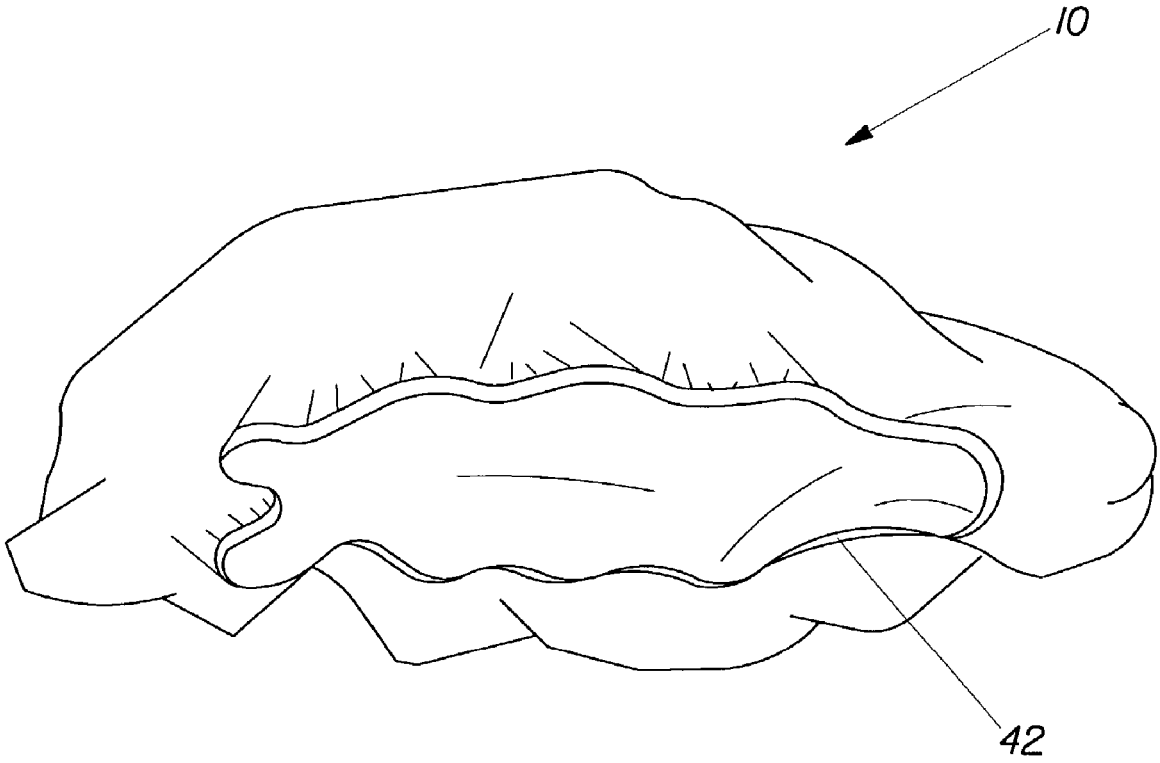
FIG. 5 depicts a fifth embodiment of a container covering system in accordance with the present invention.

FIG. 5 depicts a fifth embodiment of a container covering system 5 in accordance with the present invention. In this embodiment, the cover 10 comprises a peripheral portion 42 that is a compressible or conformable material configured to provide a gasket-like seal around a container 20. For example, the peripheral portion 42 of the cover might comprise a compressible or conformable material that is elastic or, more particularly, the peripheral portion 42 may be a foamed elastic. In this example, the foamed elastic could be compressed due to tension in the foamed elastic peripheral portion 42 to conform to the shape of the container 20, thereby creating a seal between the cover 10 and the container 20. In this embodiment, the cover 10 might be capable of forming a seal against non-stick surfaces such as Teflon, or when a layer of water and/or condensate, cooking/food oils, or release sprays are present on a surface of the container 20 that might otherwise inhibit an adhesive seal.

In the above cited examples, the cover 10 may be provided in a range of sizes to accommodate a range of container 20 sizes. Preferably, these sizes would overlap some, giving the user a choice of how tight a fit is desired.

Having shown and described various embodiments of the present invention, further adaptations of the container covering system of the present invention as described herein can be accomplished by appropriate modifications by one of ordinary skill in the art without departing from the scope of the present invention. Several of these potential modifications and alternatives have been mentioned, and others will be apparent to those skilled in the art. For example, while exemplary embodiments of the system have been discussed for illustrative purposes, it should be understood that the elements described will be constantly updated and improved by technological advances. Accordingly, the scope of the present invention should be considered in terms of the following claims and is understood not to be limited to the details of structure, operation or process steps as shown and described in the specification and drawings.

We claim:

1. A container covering system comprising:

a flexible film cover including an elastic peripheral portion and a sealing portion, wherein the sealing portion is capable of sealing the film cover to a container when the elastic peripheral portion is disposed about the container, wherein the elastic peripheral portion of the film cover has an adhesive element disposed thereon and wherein upon contact of the elastic peripheral portion to the container, the elastic peripheral portion is capable of forming a seal thereto, wherein the adhesive element is provided with a protective cover, wherein the protective cover for the adhesive element comprises a loop stitching configured to cover at least about 50% of the adhesive element.

2. The container covering system of claim 1, wherein the adhesive element is inactive when the elastic peripheral portion is in a relaxed state.

3. The container covering system of claim 1, wherein the adhesive element is exposed upon stretching of the elastic peripheral portion.

4. The container covering system of claim 1, wherein the elastic peripheral portion is provided with a protective coating to prevent adhesive contact of the adhesive element with a surface when the elastic peripheral portion is in a relaxed state.

5. The container covering system of claim 1, wherein the adhesive element is a pressure sensitive adhesive.

6. The container covering system of claim 1, wherein the elastic peripheral portion is contoured elastic.

7. The container covering system of claim 1, wherein the elastic peripheral portion comprises a compressible or conformable material.

8. The container covering system of claim 7, wherein the compressible or conformable material is foamed elastic.

9. The container covering system of claim 1, wherein the seal is substantially liquid impervious.

10. The container covering system of claim 1, wherein the elastic peripheral portion forms a releasable seal around the container.

11. The container covering system of claim 10, wherein the releasable seal is resealable.

12. The container covering system of claim 1, wherein the sealing portion has an adhesive element-disposed thereon, wherein said adhesive element seals the film cover to the container.

* * * * *